US005418508A

United States Patent [19]

Puurunen

[11] Patent Number: 5,418,508

[45] Date of Patent: May 23, 1995

[54] HELIX RESONATOR FILTER

[75] Inventor: Pertti Puurunen, Oulu, Finland

[73] Assignee: LK-Products Oy, Kempele, Finland

[21] Appl. No.: 157,361

[22] Filed: Nov. 23, 1993

[30] Foreign Application Priority Data

Nov. 23, 1992 [FI] Finland ..... 925315

[51] Int. Cl.[6] ..... H01P 1/20; H01P 7/00

[52] U.S. Cl. ..... 333/202; 333/219

[58] Field of Search ..... 333/202, 219, 206, 243, 333/244, 222, 245

[56] References Cited

U.S. PATENT DOCUMENTS

| | | | |
|---|---|---|---|
| 3,101,461 | 8/1963 | Henry-Bezy et al. | 333/252 |
| 3,387,237 | 6/1968 | Cook | 333/252 |
| 3,487,340 | 12/1969 | Curtis, III et al. | 333/248 |
| 4,061,992 | 12/1977 | Inokuchi | 333/202 |

FOREIGN PATENT DOCUMENTS

| | | | |
|---|---|---|---|
| 0455505 | 11/1991 | European Pat. Off. | 333/219 |
| 2224888 | 5/1990 | United Kingdom . | |
| 05046 | 6/1989 | WIPO . | |

OTHER PUBLICATIONS

Patent Abstracts of Japan, vol. 9, No. 288 (E-358)(2011) 15 Nov. 1985 & JP-A-60 127 802 Matsushita Denki Sangyo K.K.) 8 Jul. 1985.

*Primary Examiner*—Seungsook Ham
*Attorney, Agent, or Firm*—Darby & Darby

[57] ABSTRACT

A filter construction known in the art comprises at least a number of helix resonators (1) and an insulation material plate, the projections (2*a*) projecting from the rectangular lower part (2) whereof are provided inside the helix resonators and thus supporting them. The filter housing (6), defined by a cover (8) and the side walls, is provided with compartments, so that each compartment includes a helical resonator. As taught by the invention, at least two guides (71) projecting from the surface are extruded in the same phase as the compartment on the inner surface of the cover, wherebetween the tip part of the projection (2*a*) supporting the resonator enters when the filter is assembled. The guide can be a hemisphere or a rib-like bulge.

16 Claims, 3 Drawing Sheets

HELIX RESONATOR FILTER

FIELD OF INVENTION

The present invention relates to a helix resonator filter assembly comprising at least one helically wound electrical conductor supported by an insulating member and disposed within an extrusion formed housing having guide means disposed therein, the insulating member having a portion extending beyond at least one helically wound electrical conductor.

BACKGROUND TO INVENTION

The helix resonator is a transmission line resonator with a physical length of about a quarter of wavelength. The resonator comprises inductive elements consisting of a conductor wound into a cylindrical coil and encapsulated by a metallic housing spaced apart therefrom. The low impedance (grounded) end of the coil can be connected directly to the metallic housing, and the opposite end, a high-impedance end, is spaced away from the housing and capacitatively coupled thereto.

The characteristic impedance of the helix resonator is determined by the ratio of the coil diameter and the inner dimensions of the encapsulating housing, by the distance of the turns of the coil from each other, i.e. by the so-called pitch, and possibly, by the insulating material supporting the resonator. The resonant frequency of the helix resonator is a function of the physical properties of the coil, the capacitative structure, and the distance of the high-impedance end from the housing. Therefore, in order to produce a resonator of a given frequency band, a precise and exact structure is required.

By electromagnetically coupling resonators together, a filter provided with desired properties can be constructed. In practice, this is accomplished by the resonator coils being inserted in one and same housing and having a partition disposed between individual resonators. The size of any apertures in the partition determines the electromagnetic coupling between the resonators.

As mentioned above, the resonator coil can be mechanically supported and attached via the insulating material to the housing. The support can comprise injection moulded plastic bonds, which on one side are bound on the wall of the housing and on another side contact a few rotations of the resonator. Also a cylindrical insulating body can be used, around which the conducting wire of the resonator may be wound. Finnish patent FI-78198 discloses a helix resonator in which the resonator coil has been supported with an insulation plate, on which an electrical circuit made from strip lines has moreover been disposed, to which circuit the resonator has been coupled electrically. Said construction which forms the starting point for the present application, is presented in FIGS. 1 and 2. The four-circuit filter construction presented therein comprises four discrete helix resonators 1 wound from metal wire into a cylindrical coil. Each resonator has been fitted around the finger-resembling projections 2*a* of the plate 2 made from an insulating material. The construction is known in the art as a comb structure. In the lower part of the insulation plate an electric circuit can be produced from strip lines 3, to which the resonator is coupled e.g. by soldering at points indicated by reference numerals 4. Each resonator has also been at the upper end attached to projection 2*a* by soldering it to the metallized point in the projection. Such points of juncture are indicated in FIG. 1 by reference numeral 5. In the upper edge of each projection 2*a* and in the ends of the lower part of the insulation plate there is provided a foil strip 6 for soldering the insulation plate to the housing. The projection is soldered to the cover using a manner described below.

The housing, shown in FIG. 3, is an elongate extruded box, having an upper surface 8 and four side surfaces, and three partitions, of which walls 9 and 12 are shown. Each partition is provided with a slit 10 extending upwards from the lower edge, the length thereof being the same as the height P of the integral lower part of the circuit board. In this manner four compartments are produced. The circuit board with the resonators thereon is inserted into the housing so that each resonator enters its individual compartment. The circuit board intrudes into the slits in the partitions and the tips of the finger-resembling projections 2*a* enter the apertures 11 made on the cover of the housing. The ends 7,7′ of the lower part of the circuit board enter the grooves made in the end walls of the housing. In this manner the circuit board is supported by the ends, the tips of the finger-resembling projections and at three points in the middle to the housing. The final fixing is done by soldering the foil strip 6 at the tips of the projections (FIG. 1) onto the housing cover, and the ends 7,7′ of the circuit board at the equivalent foil strips to the end walls of the housing. Finally, a bottom plate can be fixed, whereby the entire structure becomes encapsulated.

The end result is shown in FIG. 3 in which the housing is partly sectioned for the sake of clarity. Merely the tips of the projections and the end surfaces 7 of the lower part of the board are visible of the circuit board.

Below, a closer look is taken on how in a state of the art structure the projections have been supported by and connected to the cover of the housing. The method is shown by FIGS. 4,5 and 6. FIG. 4 shows a cross-sectional view B—B of the filter shown in FIG. 3, FIG. 5 shows a top view of the supporting point, and FIG. 6 shows a cross-sectional view in the longitudinal direction of the housing. FIG. 5 shows that on the cover of housing 6 a T-shaped indentation 13 has been formed, the transversal part thereof being substantially equal to the broad dimension of projection 2*a*, i.e. the thickness of the circuit board and the width of the projection. Thus, the tip of the projection 2*a* enters that part of the indentation. The longitudinal part of the T indentation serves as the exit for surplus soldering paste when the projection is soldered on to the cover of the housing. The indentation may also be rectangular in shape if the discharge of paste has otherwise been addressed. After forming the indentation, the area around the punching point is depressed with a round-ended stick placed perpendicularly against the surface of the housing so that the edges of the area around the punching point bend somewhat inwards into the housing. The line along which the surface of the housing is depicted by broken line L in FIG. 5, and the bending is clearly visible in FIGS. 4 and 6. The conical depression found by the bending facilitates guiding the projection 2*a* of the circuit board into the indentation, thus improving the soldering of the projection onto the edge of the indentation.

The fixing operation described above involves a number of drawbacks. Firstly, punching the upper surface of the housing is an additional and slow work phase. The punching is accomplished for a large series of housings. Since even a minor error in positioning the punching point greatly affects the properties of the finished filter, endeavours must be made to keep the punching points identical from one housing to another. In practice, this is difficult to maintain. Secondly, when the circuit board is being inserted into the housing, and the tips of the projections intrude into the indentations of the housing cover, it often happens that the sides of the projections become abraded against the edges of the indentations and the soldering foil on the tips get rolled off from the surface of the board. Thus, soldering is no longer so successful as required, thus resulting in a rejected filter.

SUMMARY OF INVENTION

The present invention provides a helix resonator filter assembly comprising at least one helically wound electrical conductor supported by an insulating member and disposed within an extrusion formed housing having guide means disposed therein, the insulating member having a portion extending beyond an end of the at least one helically wound electrical conductor and wherein the guide means disposed within the housing are extrusion formed substantially contemporaneously with the housing and are adapted to receive portion.

As taught by the invention, the insulation plate is taken into consideration at such early stage as the housing of the filter is extruded. Nowadays, the housing is manufactured by extruding from an aluminium mixture into one piece, said piece also comprising the partitions. It has now been understood that in one and the same extrusion phase of the housing, appropriate guides can be extruded on the lower surface of the cover inside the housing, between which guides the projection tip of the insulation plate becomes directed when the insulation plate is with the resonators inserted into the housing. Thus, the problems associated with punching the housing are overcome. The guide consists of at least two symmetrical parts projecting by the plane of the board surface and by a space of the thickness of the insulation plate from each other. The part can be semi-spherical in shape, the curved surfaces whereof guiding the insulation plate properly between said parts and furthermore, against the undersurface of the cover. The parts may also be ribs located in parallel at a space from one another, whereby the insulation plate is inserted between the ribs. The length of the rib can be selected freely, so that it can be shorter or equal in length compared with the width of the projecting part of the insulation plate, or it may extend over the entire length of the compartment. If the rib is short in length, it is preferable to round the ends thereof. The most appropriate shape of the cross-section of the rib is approximately semi-spherical. The cross-section is greatly influenced by the technical possibilities allowed by the extrusion tools. By having rounded ribs or guides the metallized foil section is less likely to be abraded and the foil scratched off.

On the inner sides of the end surfaces of the housing extruded guides can be provided. Hereby, the width of the lower part of the insulation plate is equal to the inner diameter measured in the longitudinal direction of the housing. Such guides can be short, i.e. they may only extend some way from the lower edge of the housing towards to upper edge, although for the extrusion technical reasons, the guides in practice extend over the entire height of the end surface, that is, from the lower edge to the upper edge. The insulation plate is thus pushed between the guides of the end surfaces into the housing until the plate encounters the guides of the housing cover and pushes itself therebetween. Finally, the insulation plate is fixed by soldering to the housing.

The invention is described below by way of example only, and with the aid of the aforementioned figures.

Figure 1:
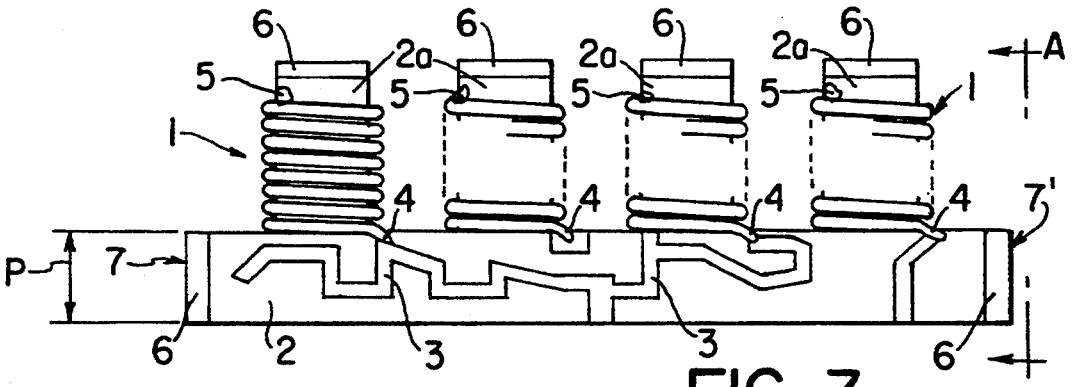
FIG. 1 (PRIOR ART)
FIG. 1 presents the filter structure in elevational view and without a housing.
Figure 2:
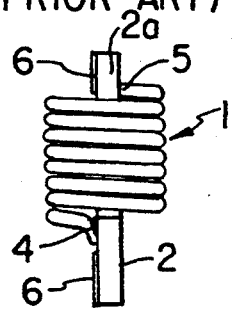
FIG. 2 (PRIOR ART)
FIG. 2 shows the structure of FIG. 1 viewed in direction A—A.
Figure 3:
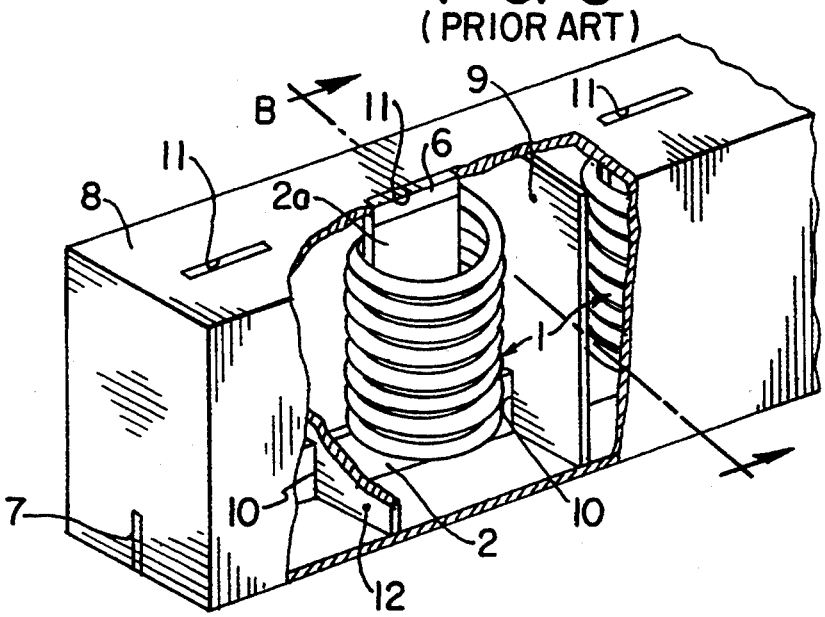
FIG. 3 (PRIOR ART)
FIG. 3 illustrates a partly sectioned filter.
Figure 4:
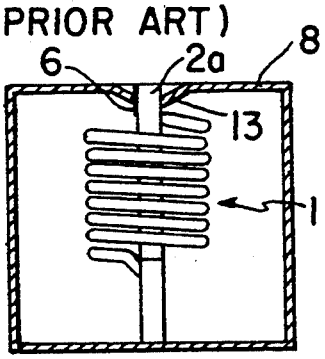
FIG. 4 (PRIOR ART)
FIG. 4 is a cross-section of the upper part of the filter, presenting the prior art fixing.
Figure 5:
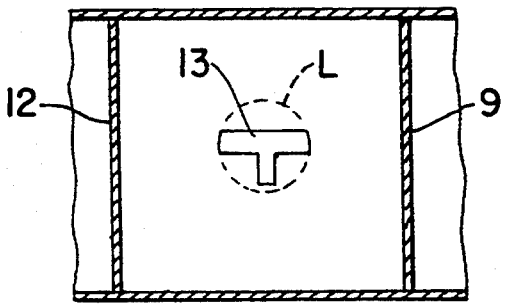
FIG. 5 (PRIOR ART)
FIG. 5 presents the housing in top view at a prior art fixing point.
Figure 6:
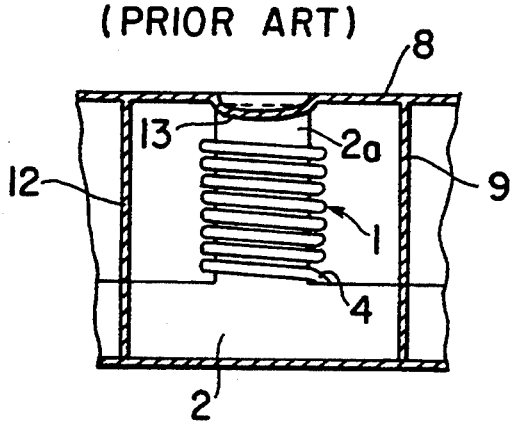
FIG. 6 (PRIOR ART)
FIG. 6 presents the section of the filter in the longitudinal direction of the filter at one resonator.

FIGS. 1 to 6 are described above in conjunction with the state of art description. In referencing of FIGS. 7 to 9, the reference numerals of FIGS. 1 to 3 are employed when applicable.

Figure 7A:
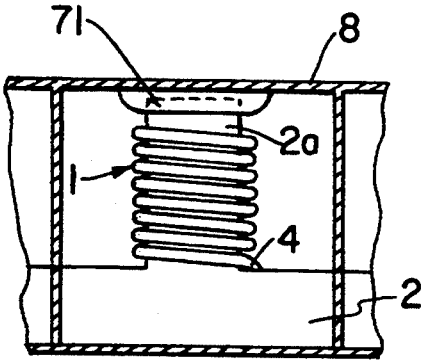
FIG. 7A illustrates the cross-section of the upper part of the filter, provided with guides according to the invention.
Figure 7B:
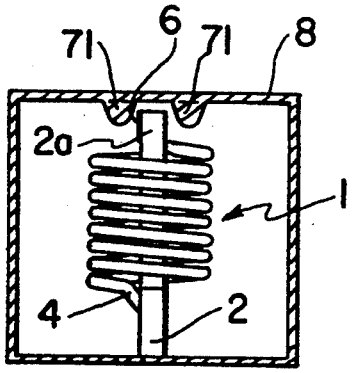
FIG. 7B illustrates the section of the filter in longitudinal direction at one resonator provided with guides as shown in FIG. 7A.

In accordance with a first embodiment of the invention, i.e. FIGS. 7A and 7B, two parallel ribs 71 are formed during the extrusion process at positions corresponding to each compartment of the housing, on the inner surface of the housing cover 8. The ribs 71 run on the surface at both sides of the longitudinal centreline of the housing, and the distance between them is substantially equal to the projection 2*a* of the insulation plate. The length of ribs 71 can be smaller than the width of projection 2*a*, slightly greater than the width of the projection, as is shown in FIG. 7A, or the rib may extend on the inner surface of the cover over the length of the two side walls 9,12 of the compartment.

A cross-sectional view of the ribs is shown in FIG. 7B. The ribs 71 are most preferably provided with an arched surface, e.g. a circular arc. When an insulation plate with resonators is pushed into the housing, the tip of the projection 2A enters between said ribs 71. The arched shape of the cross-section of the ribs causes the tip of the projection to easily guide between the ribs and against the cover of the housing. The foil on the tip of the projection is inhibited from being damaged or rolled off from the surface because of the ribs 71 sloping surface and thus the soldering at a later stage is easy.

Figure 8A:
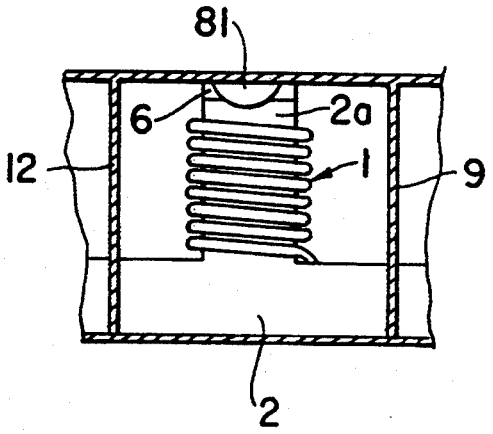
FIG. 8A is equivalent to FIG. 7A when using the guides of a second embodiment.
Figure 8B:
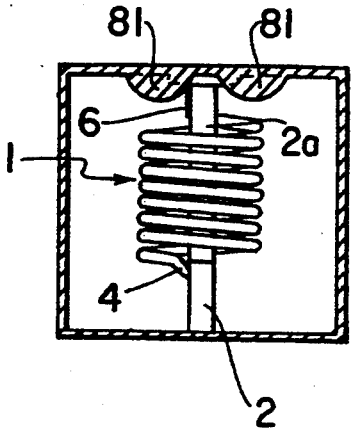
FIG. 8B is equivalent to FIG. 7B when using the guides of a second embodiment.

In FIGS. 8A and 8B, the guides are formed of semicircles 81 extruded on the lower surface of the housing cover at each compartment. The effect of a semi-circular guide on the capacitative field of the resonator is lesser than that of a rib guide. As in the rib guides, the projection 2a of the insulation plate intrudes between the semi-circular guides without damaging the foil of the projection, whereby later soldering is easy to carry out.

Figure 9A:
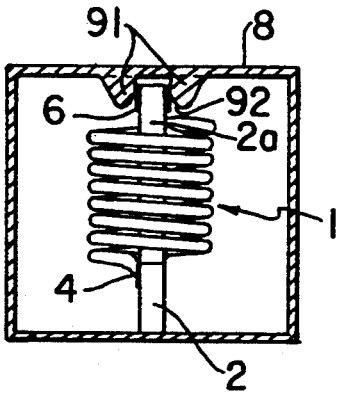
FIG. 9A presents transversally a guide according to a third embodiment.
Figure 9B:
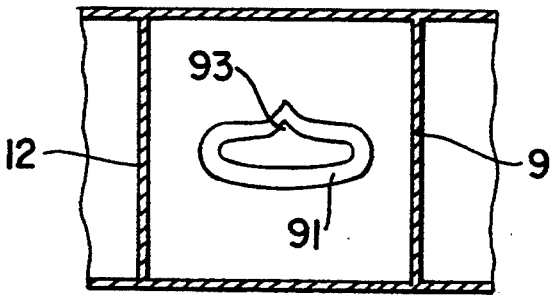
FIG. 9B presents the guide as shown in FIG. 9A viewed in the pushing direction of the insulation plate.

The guide shown in FIGS. 9A and 9B is a frame 91 produced within each compartment inside the housing cover. The projection tip of the insulation plate is surrounded on all sides thereby. The cross-section of the frame, as shown in FIG. 9A, is such that it is provided with an inclined surface 92 to guide the projection 2A into the frame. With a view to soldering, it is preferable to provide the frame with an exit path for the excess paste. In FIG. 9B, presenting the frame 91 viewed in the insertion direction of the insulation plate, the exit path is indicated by reference numeral 93, said path being simply a small bend in the frame. When the projection 2a of the insulation plate has been positioned within the frame, the excess paste is allowed to exit via said bend.

Figure 10:
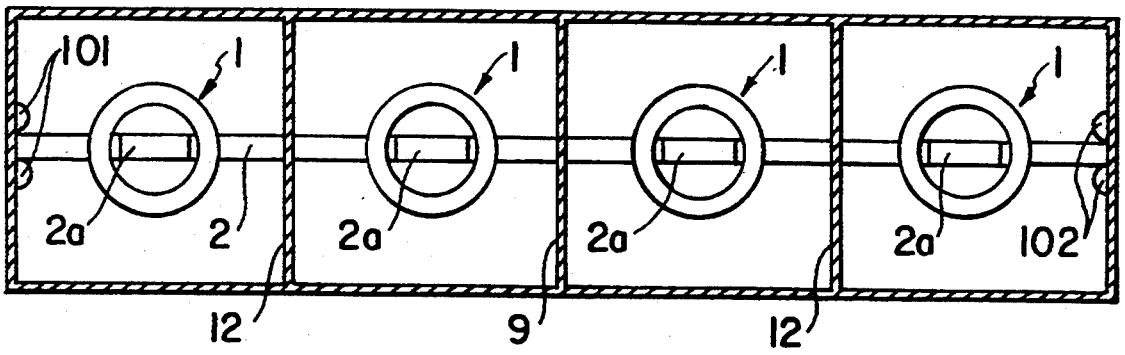
FIG. 10 presents in top view a cross-section of the filter in which the guides on the end surfaces are shown.

Guides may also be extruded onto the inner surfaces of the end surfaces of the housing. This is illustrated in FIG. 10 showing the top view of a splitted filter. The indentations of the end faces shown in FIG. 3 have been replaced by inner guides 101,102, extending from an edge of the end face. The length of a guide can be approximately the same as the height of the lower part 2 of the insulation plate, though in practice, extrusion of such a short guide is not always successful thus the guide is designed to extend over the height of the entire end face. The shape of the guide is preferably rib-like.

Next, the insulation plate to which the resonators have been attached is pushed between the guides of the end surfaces into the housing until the guides on the bottom of the compartments have guided the projections against the lower surface of the housing bottom. Thereafter the insulation plate is soldered from the foil strips in the tips of the projections 2a and the sides of the lower part 2 (not shown) to the housing. Finally, the bottom can be covered with a metal plate, whereby a completely encapsulated filter is produced.

Thanks to guides in accordance with the present invention, no punchings need to be made onto the housing, nor is the insulation plate visible at any point from outside. This reduces the RF radiation leaking from the housing. Also the visual appearance of the housing is improved. The soldering surfaces of the insulation plate will no longer be peeled off, so that savings are gained in the insulation material. It is no longer necessary to make any indentations in the housing to guide the insulation plate.

The shape of the guides is in no way limited in the claims. They can be provided to be of any shape, merely the extrusion technology sets restrictions to the shape. While maintaining within the protective scope, features known in the art can be combined with the design of the invention. If desired, an elongated groove can be cut between the guides in the cover of the housing, wherebetween the insulation plate enters. An aperture or apertures of circular shape, or of some other shape, may also be cut between the guides. Said apertures and the groove facilitate visual inspection of how successful the soldering had been.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

I claim:

1. A helix resonator filter assembly, comprising:

at least one helically wound electrical conductor supported by an insulating member, said insulating member having an insulating portion extending beyond an end of said at least one helically wound electrical conductor;

an extrusion formed housing defining an interior space and having guide means extending into said interior space, said at least one helically wound electrical conductor and supporting insulating member being disposed within said interior space; said guide means including a pair of guide members that are extrusions and are free of bent portions, said guide members each extending within said interior space and being configured and spaced apart for guiding said insulating portion therebetween.

2. A helix resonator filter assembly as set forth in claim 1, wherein said guide means comprise elongated ribs.

3. A helix resonator filter assembly as set forth in claim 2, wherein said ribs extend from one side wall (9) of the housing to an opposite side wall of said housing.

4. A helix resonator filter assembly as set forth in claim 2, wherein the length of said ribs are smaller than the distance between side walls of said housing and that the ends of the ribs are rounded.

5. A helix resonator filter assembly as set forth in claim 1, wherein said guide means comprises hemispheres.

6. A helix resonator filter assembly as set forth in any preceding claim, wherein further guide means are formed on inner surfaces of end faces of said housing and extend into said interior space, ends of a lower part of said insulating member being disposed between the further guide means, said further guide means being free of bent portions.

7. A helix resonator filter assembly as set forth in claim 6, wherein said further guide means comprise two parallel ribs extending from a lower edge of said housing towards a cover of said housing.

8. A helix resonator filter assembly as set forth in claim 6, wherein said further guide means comprise at least two semi-spherical bulges.

9. A helix resonator filter assembly as set forth in claim 1 or 6, wherein said insulating portion have metallized end portions and said insulating member is fixed into said housing by soldering said metallized end portions to said guide means.

10. A helix resonator filter assembly as set forth in claim 6, wherein the ends of the lower part of said insulating member have metallized end portions and said insulating member is fixed into said housing by soldering said metallized end portions to said further guide means.

11. A method of assembling a helix resonator filter, comprising the steps of:

supporting at least one helically wound electrical conductor by an insulating member, said insulating member having an insulating portion extending beyond an end of said at least one helically wound electrical conductor;

extrusion forming a housing that defines an interior space and that has a pair of guide members extending into said interior space, disposing said at least one helically wound electrical conductor and supporting insulating member within said interior space, said pair of guide members being extrusions that are free of bent portions, said pair of guide members extending within said interior space and each being configured and spaced apart from each other for guiding said insulating portion therebetween.

12. A method as in claim 11, further comprising the step of guiding said insulating member between said guide members.

13. A method as in claim 11, further comprising the step of forming said guide members and said housing substantially contemporaneously by extrusion.

14. A method as in claim 11, further comprising the step of forming further guide members on inner surfaces of end faces of said housing and thereafter disposing ends of a lower part of said insulating member between said further guide members.

15. A method as in claim 14, wherein ends of the lower part of said insulating member are metallized; further comprising the step of fixing said insulating member into said housing by soldering said metallized end portions to said further guide members.

16. A method as in claim 11, wherein ends of the said insulating member are metallized; further comprising the step of fixing said insulating member into said housing by soldering said metallized end portions to said guide members.

* * * * *